US005949391A

United States Patent [19]

Saishu et al.

[11] Patent Number: 5,949,391

[45] Date of Patent: Sep. 7, 1999

[54] LIQUID CRYSTAL DISPLAY DEVICE AND DRIVING METHOD THEREFOR

[75] Inventors: Tatsuo Saishu; Hiroyuki Nagata, both of Yokohama; Haruhiko Okumura, Fujisawa; Hisao Fujiwara, Yokohama, all of Japan

[73] Assignee: Kabushiki Kaisha Toshiba, Kawasaki, Japan

[21] Appl. No.: 08/914,654

[22] Filed: Aug. 19, 1997

[30] Foreign Application Priority Data

Aug. 20, 1996 [JP] Japan ..... 8-218441

[51] Int. Cl.[6] ..... G09G 3/18

[52] U.S. Cl. ..... 345/50

[58] Field of Search ..... 345/50, 49, 87, 345/88, 90, 92

[56] References Cited

U.S. PATENT DOCUMENTS

| | | | |
|---|---|---|---|
| 4,803,480 | 2/1989 | Soneda et al. | 340/784 |
| 4,842,371 | 6/1989 | Yasuda et al. | 350/333 |
| 5,082,353 | 1/1992 | Kawasaki | 359/63 |
| 5,446,562 | 8/1995 | Sato | 359/59 |
| 5,689,281 | 11/1997 | Nomura | 345/94 |
| 5,774,099 | 4/1996 | Iwasaki et al. | 345/87 |

FOREIGN PATENT DOCUMENTS

| | | |
|---|---|---|
| 7-64056 | 3/1995 | Japan . |
| 8-15671 | 1/1996 | Japan . |

OTHER PUBLICATIONS

A.G.H. Verhulst et al., "A Wide Viewing Angle Video Display Based On Deformed Helix Ferroelectric LC and a Diode Active Matrix", International Display Research Conference 1994 (IDRC '94) Digest, 1994, pp. 377–380.

*Primary Examiner*—Mark K. Zimmerman
*Assistant Examiner*—Ronald Laneau
*Attorney, Agent, or Firm*—Finnegan, Henderson, Farabow, Garrett & Dunner, L.L.P.

[57] ABSTRACT

A liquid crystal display device comprises a first substrate, plural pixel electrodes arranged in rows and columns on the first substrate, plural switching elements, an end of the conduction path of each of the switching elements being connected to a corresponding one of the pixel electrodes, a second substrate that is opposed to the first substrate, a common electrode formed on the second substrate and opposed to the pixel electrodes, a liquid crystal material with spontaneous polarization sandwiched between the first and second substrates, plural signal line bundles arranged on the first substrate substantially parallel with one another along the columns, each of the signal line bundles comprising a predetermined number of signal lines and each of the signal lines being connected to the other end of the conduction path of each of selected switching elements arranged along a corresponding one of the columns, plural scanning lines arranged on the first substrate substantially parallel with one another along the rows and connected to the control terminals of the switching elements, and plural drivers each for driving a predetermined number of scanning lines. The drivers correspond in number to the signal lines of each of the signal line bundles, and each of the drivers drives corresponding scanning lines.

20 Claims, 8 Drawing Sheets

LIQUID CRYSTAL DISPLAY DEVICE AND DRIVING METHOD THEREFOR

BACKGROUND OF THE INVENTION

The present invention relates to a method of driving a liquid crystal display device which is equipped with thin film transistors (hereinafter referred to as TFTs) arranged in a matrix configuration and has a liquid crystal material of spontaneous polarization sandwiched between a cell array forming substrate (hereinafter referred to as an array substrate) and a color-filter substrate which are opposed to each other.

Conventionally, active-matrix liquid crystal display devices have been extensively used which are equipped as control devices with TFTs. This type of liquid crystal device has no crosstalk between respective pixels, provides high-contrast display, enables transmissive display, and has an advantage that the screen area can be increased easily.

In order to further improve such TFT liquid crystal display devices in response speed and viewing angle, investigations have recently been made on the use, as a liquid crystal material, of ferroelectric liquid crystal or antiferroelectric liquid crystal, which has spontaneous polarization like chiral smectic C phase liquid crystal or its sub-phase liquid crystal, in place of twisted nematic liquid crystal (hereinafter referred to as TN liquid crystal). If, when the chiral smetic C phase liquid crystal or its sub-phase liquid crystal is driven with TFTs, the write time is shorter than the liquid crystal response time, then the holding voltage will lower because of a depolarization field (Hartmann: J. Appl. Phys. 66, 1132 (1989)).

The lowering of the holding voltage results in insufficient writing of data. When the effective applied voltage lowers, the contrast ratio decreases, which adversely affects image quality. The insufficient data writing can be compensated for by raising the applied voltage. To this end, however, medium voltage drivers or arrays must be used, which increases manufacturing cost. In addition, power consumption is increased. For this reason, particularly small, portable liquid crystal display devices that have low power consumption requirements cannot achieve a reduction of power consumption. Thus, the time that the battery can be used is reduced and the operability is degraded.

In frame inversion driving in which the applied voltage is driven in the positive/negative symmetric mode with its polarity inverted with each frame, when the absolute value of a signal voltage changes in some frame, the displayed image cannot immediately reach the quantity of transmitted light corresponding to a new signal voltage. In this case, the displayed image will reach the steady quantity of transmitted light while alternating between brightness and darkness over several frames. This phenomenon is called the step response (Verhulst et al: SID '94 digest, 337 (1994)), which degrades the image quality. To solve this problem, a method of eliminating the step response by driving the applied voltage in the asymmetric mode (as opposed to the symmetric mode) has also been investigated (Tanaka et al: SID '94 digest, 430 (1994)). In this case, although the contrast ratio is improved by accumulative response, there arise new problems of a decrease in the image response speed and image sticking due to ununiform distribution of impurities in liquid crystal or afterimage due to residual hysteresis.

Moreover, to solve the holding voltage and step response problems, means of increasing storage capacitance has also been investigated. In the case of liquid crystal display devices using TN liquid crystal, the storage capacitance is substantially the same as the capacitance associated with each pixel having liquid crystal. If, when ferroelectric or antiferroelectric liquid crystal is used, the storage capacitance is increased by a factor of ten or more over that in the TN liquid crystal display device, then the holding voltage problem will be solved. However, as long as the liquid crystal response speed is slow as it stands, the step response problem will not be solved. Furthermore, since increasing the storage capacitance results in an increase in power consumption, which makes the burden on the driving circuitry heavy. Thus, this method is not suited for small display devices.

As another method of solving the step response problem, conventionally a method has also been carried out in liquid crystal display devices that use TFTs or thin film diodes (hereinafter referred to as TFDs), which performs a reset operation of applying 0 volts to each pixel electrode immediately prior to a write operation to thereby make the holding voltage 0 volts for a portion of the time required to write in the applied voltage.

With the conventional method of performing a reset operation using a portion of the write time, however, the substantial write time becomes reduced unless the number of scanning lines is decreased because the frame time is predetermined. A decrease in the write time results in insufficient writing in. Thus, a sufficient improvement in contrast cannot be achieved. With liquid crystal display devices in which the write time is reduced as a result of increasing the number of lines to achieve high definition or increase the screen size, the write time becomes further reduced due to the reset operation. The bad effects of poor writing are enhanced and the display quality is degraded considerably due to poor contrast.

A liquid crystal display device has also been proposed which uses a circuit arrangement that is equipped with two TFDs for each pixel and uses two signal lines for data and reference, the data signal line being used to write data into a line and the reference signal line being used to reset other lines than the line that is being written into by the data signal line (Verhulst et al: IDRC '94 digest, 377 (1994)). With this circuit arrangement, the numbers of switching devices and lines per pixel increase and the driving waveforms become complicated, decreasing the manufacturing yield and preventing manufacturing cost from lowering. Further, the use of TFDs makes it difficult to control variations in overall liquid crystal display device characteristics.

BRIEF SUMMARY OF THE INVENTION

It is therefore an object of the present invention to provide a liquid crystal display device and driving methods therefor which prevent the lowering of holding voltage due to a depolarization field and eliminate the step response without raising driving voltage and increasing manufacturing cost, to thereby provide improved displayed images with high display contrast, no afterimage due to residual hysteresis, and no image sticking and flicker due to ununiform distribution of impurities.

According to a first aspect of the present invention there is provided a liquid crystal display device comprising: a first substrate having a first major surface; a plurality of pixel electrodes arranged in rows and columns on the first major surface of the first substrate; a plurality of switching elements each having a conduction path and a control terminal adapted to control the conduction of the conduction path, an end of the conduction path of each of the switching elements being connected to a corresponding one of the pixel electrodes; a second substrate having a second major surface that is opposed to the first major surface of the first substrate; a common electrode formed on the second major surface of the second substrate and opposed to the pixel electrodes; a liquid crystal material with spontaneous polarization sandwiched between the first major surface of the first substrate and the second major surface of the second substrate; a plurality of signal line bundles arranged on the first major surface of the first substrate substantially parallel with one another along the columns and formed so as to correspond with the respective columns, each of the signal line bundles comprising a predetermined number of signal lines and each of the signal lines of a signal line bundle being connected to the other end of the conduction path of each of selected elements of the switching elements arranged along a corresponding one of the columns; a plurality of scanning lines arranged on the first major surface of the first substrate substantially parallel with one another along the rows, each of the scanning lines being connected to the control terminals of the switching elements arranged along a corresponding one of the rows; and a plurality of drivers each for driving a predetermined number of scanning lines of the plurality of scanning lines, the drivers corresponding in number to the signal lines of each of the signal line bundles and each of the drivers driving corresponding scanning lines each of which is connected to the control terminals of the selected elements of the switching elements.

Each of the drivers can simultaneously perform a write operation of an arbitrary one of the corresponding predetermined number of scanning lines and a reset operation of at least one other than the arbitrary one of the scanning lines to reset a holding voltage thereof to a preset voltage.

In the display device, the signal lines in each of the signal line bundles can comprise a first signal line connected to switching elements in odd-numbered rows and a second signal line connected to switching elements in even-numbered rows, and the drivers can comprise a first driver for performing write and reset operations through the switching elements in the odd-numbered rows and a second driver for performing write and reset operations through the switching elements in the even-numbered rows.

The first substrate can be divided into a plurality of display sections, and, in each of the display sections, the signal lines in each of the signal line bundles can comprise a first signal line connected to switching elements in odd-numbered rows and a second signal line connected to switching elements in even-numbered rows, and the drivers can comprise a first driver for performing write and reset operations through the switching elements in the odd-numbered rows and a second driver for performing write and reset operations through the switching elements in the even-numbered rows.

Each of the switching elements should preferably be a thin film transistor.

According to a second aspect of the present invention there is provided a liquid crystal display device driving method comprising the steps of: preparing a liquid crystal display device of the first aspect; and allowing each of the drivers to simultaneously perform a write operation of an arbitrary one of the corresponding predetermined number of scanning lines and a reset operation of at least one other than the arbitrary one of the scanning lines to reset a holding voltage thereof to a preset voltage.

The predetermined number of signal lines can include first signal lines connected to the switching elements in odd-numbered rows and second signal lines connected to the switching elements in even-numbered rows, and the step of allowing each of the drivers to simultaneously perform a write operation and a reset operation includes a step in which one of the drivers performs a write operation on one of scanning lines in odd-numbered rows at the same time another of the drivers performs a reset operation on at least one of scanning lines in even-numbered rows, and the another of the drivers can perform a write operation on one of scanning lines in even-numbered rows at the same time the one of the drivers performs a reset operation on at least one of scanning lines in odd-numbered rows.

The predetermined number of signal lines can include first signal lines connected to the switching elements in the upper half section of the first substrate and second signal lines connected to the switching elements in the lower half section of the first substrate, and the step of allowing each of the drivers to simultaneously perform a write operation and a reset operation includes a step in which one of the drivers can perform a write operation on one of scanning lines on the upper half section of the first substrate at the same time another of the drivers performs a reset operation on at least one of scanning lines in the lower half section of the first substrate, and the another of the drivers can perform a write operation on one of scanning lines in the lower half section of the first substrate at the same time the one of the drivers performs a reset operation on at least one of scanning lines in the upper half section of the first substrate.

It is preferable that the number of scanning lines that are reset simultaneously with the write operation range from 1 to 10, and, for each of the scanning lines, a blank interval t between a final reset pulse for the reset operation and a write pulse for the write operation be set to anyone of 0, 2T/n, and 4T/n where T is one frame time, and n is the total number of the scanning lines.

The driving method can further comprise the step of adjusting the number of scanning lines that are reset simultaneously and the blank interval.

According to a third aspect of the present invention there is provided a liquid crystal display device driving method comprising the step of: preparing a liquid crystal display device of the first aspect in which each of the signal line bundles comprises k ($k \geqq 2$) signal lines and a number k of drivers are provided each of which corresponds to a respective one of the k signal lines; and allowing each of the drivers to perform a write operation on each of the corresponding scanning lines during a write time of $k \times T/n$ where T is one frame time and n is the total number of scanning lines.

The driving method should preferably comprises the step of performing precharging of a pixel voltage during a time interval from 0 to $k \times T/n$ immediately before the write operation.

According to a fourth aspect of the present invention there is provided a method of driving a liquid crystal display device comprising the steps of: preparing a liquid crystal display device comprising: a first substrate having a first major surface; a plurality of pixel electrodes arranged in rows and columns on the first major surface of the first substrate; a plurality of switching elements each having a conduction path and a control terminal adapted to control the conduction of the conduction path, an end of the conduction path of each of the switching elements being connected to a corresponding one of the pixel electrodes; a second substrate having a second major surface that is opposed to the first major surface of the first substrate; a common electrode formed on the second major surface of the second substrate and opposed to the pixel electrodes; a liquid crystal material of spontaneous polarization sandwiched between the first major surface of the first substrate and the second major surface of the second substrate; a plurality of signal lines arranged on the first major surface of the first substrate substantially parallel with one another along the columns and formed so as to correspond with the respective columns, each of the signal lines being connected to the other end of the conduction path of each of selected elements of the switching elements arranged along a corresponding one of the columns; and a plurality of scanning lines arranged on the first major surface of the first substrate substantially parallel with one another along the rows, each of the scanning lines being connected to the control terminals of the switching elements arranged along a corresponding one of the rows; performing a write operation on an arbitrary one of the scanning lines; and, immediately before performing the write operation on the arbitrary one of the scanning lines, performing a reset operation for resetting a holding voltage to a preset voltage on the arbitrary one and another of the scanning lines.

In the driving method, it is preferable that a plurality of reset operations be performed immediately before the write operation, the time interval for each reset operation being set equal to or less than T/(2n) where T is one frame time and n is a total number of scanning lines, and the step of performing a write operation includes a step in which, immediately after a reset operation of the another of the scanning lines is finished, the write operation of the arbitrary one of the scanning lines is started, and a sum of a time interval for the write operation and a time intervals for the reset operations is set to T/n.

In the driving method, it is preferable that the time interval for each reset operation range from T/(6n) to T/(2n), the number of scanning lines that are reset simultaneously with the write operation range from 1 to 10, and, for each of the scanning lines, a blank interval between the final reset operation and the write operation range from 0 to 3T/n.

The driving method can comprise the step of adjusting the number of scanning lines that are reset simultaneously and the blank interval.

Such arrangements of the present invention allows the use of ferroelectric liquid crystal or antiferroelectric liquid crystal to achieve high response speed and wide viewing angles. By providing a plurality of signal lines for each column and dividing scanning lines into a plurality of groups that can be driven simultaneously by separate driving systems to thereby perform simultaneously a write operation on one of rows and a reset operation on other rows, a sufficient write time can be secured without increasing the number of switching elements regardless of performing the reset operation to avoid the step response. Thus, the holding voltage can be prevented from lowering and the display contrast can be improved. The use of the plurality of driving systems facilitates the use of horizontal line inversion driving in which the polarity of applied voltage is inverted for each row and the elimination of flicker.

Since the AC driving can be used, afterimage due to residual hysteresis and image sticking due to ununiform distribution of impurities will not be produced, which are problems associated with DC driving.

By providing a plurality of signal lines for each column and dividing the scanning lines into groups that can be driven simultaneously, the write time for each row can be increased or precharging can be performed immediately prior to writing, the lowering of holding voltage due to poor writing can be prevented and the step response can be eliminated, improving the display contrast.

Prior to writing into a line, a plurality of reset operations are performed on that line simultaneously with reset operations on other lines. In this case, a fraction of a write time is allocated for a reset operation to obtain a write time long enough to ensure writing. Nevertheless, by the plurality of reset operations prior to a write operation, the total of reset time intervals can be made long enough to prevent the holding voltage from lowering and eliminate the step response. Thus, the display contrast is improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

[First Embodiment]

Figure 1A:
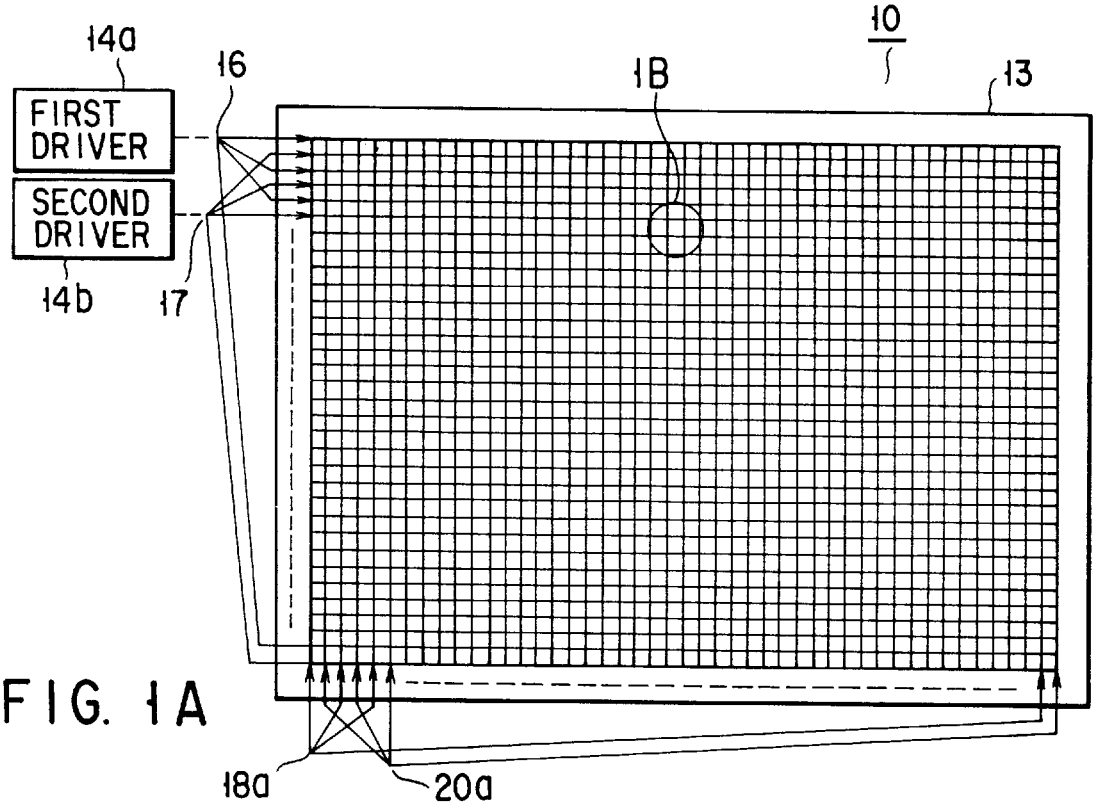
FIG. 1A is a schematic plan view of an array substrate in a liquid crystal display device in accordance with a first embodiment of the present invention.
Figure 1B:
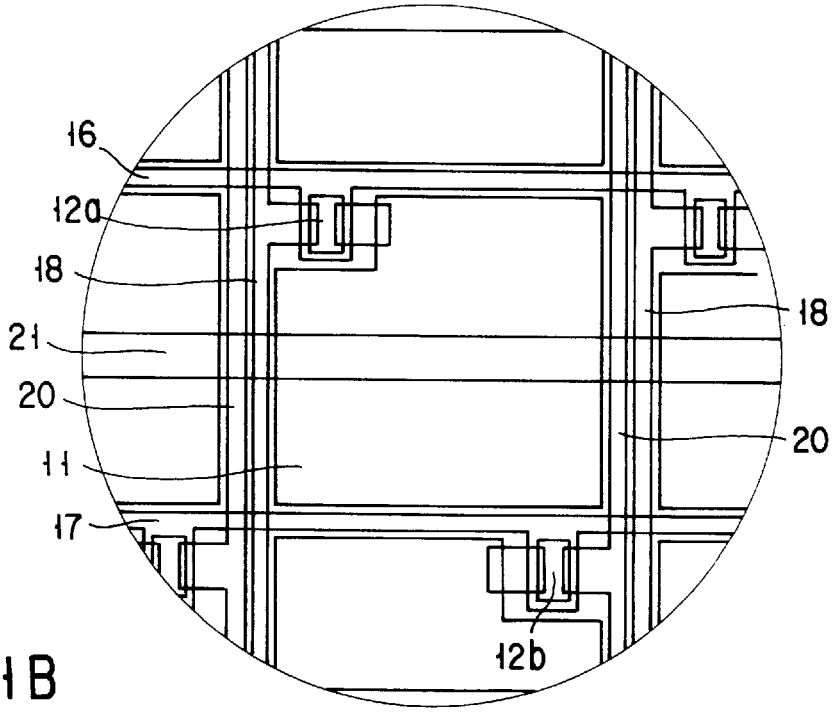
FIG. 1B is an enlarged plan view of circle 1B of FIG. 1A that corresponds to one pixel in the liquid crystal display device.

FIG. 1A is a general view of a liquid crystal display panel according to a first embodiment of the present invention, and FIG. 1B is an enlarged view of circle 1B in FIG. 1A illustrating a detailed arrangement of one pixel. In FIGS. 1A and 1B, reference numeral 10 generally denotes an array substrate that comprises a glass substrate 13 on which there are formed pixel electrodes 11 that are arranged in the form of a 640×480 matrix and TFTs 12 each of which serves as a switching device for driving a corresponding one of the pixel electrodes. Between the array substrate and a color-filter substrate (not shown) which are opposed to each other is sandwiched a material A of thresholdless antiferroelectric liquid crystal having a spontaneous polarization of 150 $nC/cm^2$, a response time of 100 microseconds, and a saturation voltage of five volts (Fukuda, Asia Display '95 digest, 61(1995)).

On the glass substrate 13 are further arranged first scanning lines 16, which are driven in sequence by a first driver system 14*a*, and second scanning lines 17, which are driven in sequence by a second driver system 14*b*, so that they alternate with each other. First signal lines 18 forming a first signal line group 18*a* and second signal lines 20 forming a second signal line group 20*a* are further arranged in such a way that they intersect with the scanning lines 16 and 17. In this case, one of the first signal lines 18 and one of the second signal lines 20 are arranged side by side between adjacent arrays of pixels along columns.

A TFT 12 is formed in the vicinity of each of intersections of the signal lines 16 and 18 and intersections of the intersections 17 and 20. A pixel electrode 11 is electrically connected to the corresponding TFT 12. Each of the TFTs 12*a* in odd-numbered rows on the array substrate 10 is connected to a corresponding one of the first scanning lines 16 and a corresponding one of the first signal lines 18. Each of the TFTs 12*b* in even-numbered rows on the array substrate 10 is connected to a corresponding one of the second scanning lines 17 and a corresponding one of the second signal lines 20. Each of the pixel electrodes 11 is driven by a corresponding one of the driver systems 14*a* and 14*b*. Reference numeral 21 denotes a storage capacitor line.

Figure 2:
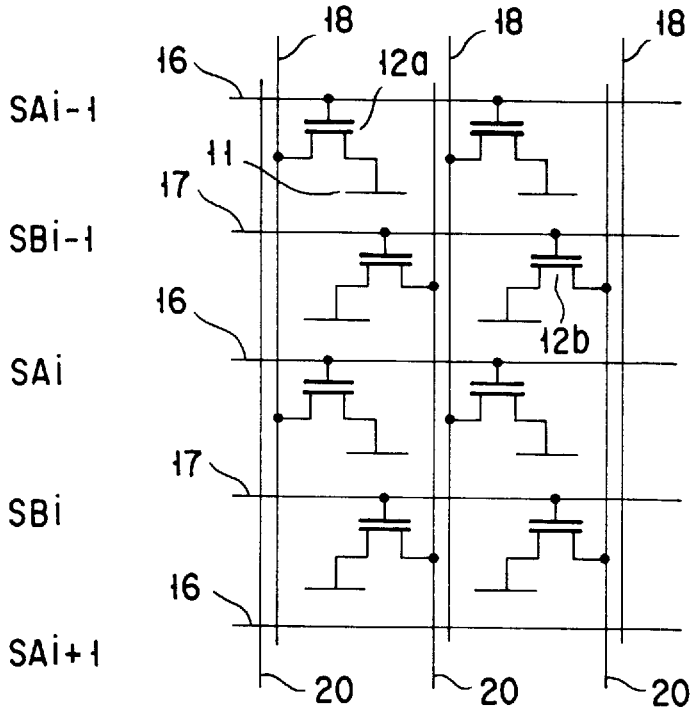
FIG. 2 is an equivalent circuit diagram of a portion of the array substrate of the first embodiment.

Next, the method of driving the liquid crystal display device will be described with reference to FIG. 2 illustrating an equivalent circuit of a portion of the array substrate 10. Note that the storage capacitor line is omitted from FIG. 2. The TFT driver system for the array substrate 10 is equivalent to a VGA driver system that provide horizontal line inversion driving in which a maximum applied voltage by the first and second signal lines 16 and 17 is ±6 volts and the 1H time is 32 microseconds. The 1H time will be described later. In FIG. 2, the first scanning lines 16 are indicated by SAi-1, SAi, SAi+1, . . . , and the second scanning lines 17 are indicated by SBi-1, SBi, SBi+1, . . .

Figure 3:
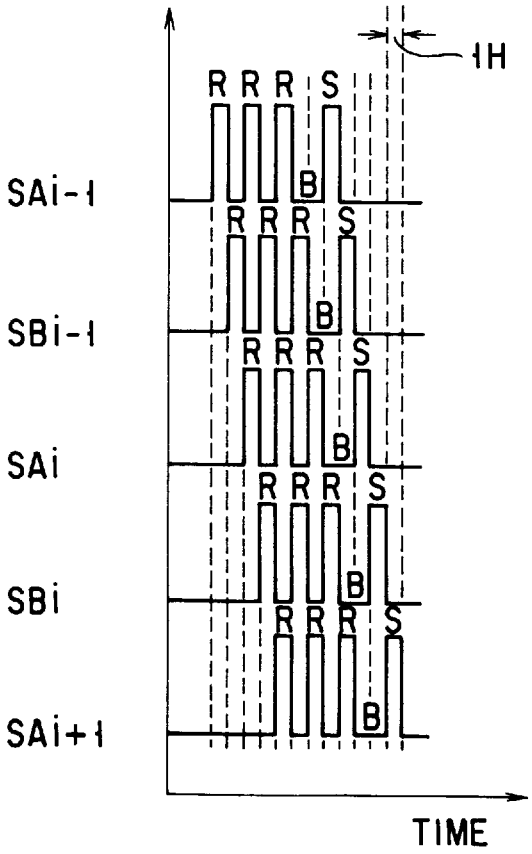
FIG. 3 is a timing diagram of scanning line driving waveforms for the scanning lines in FIG. 2.
Figure 4A:
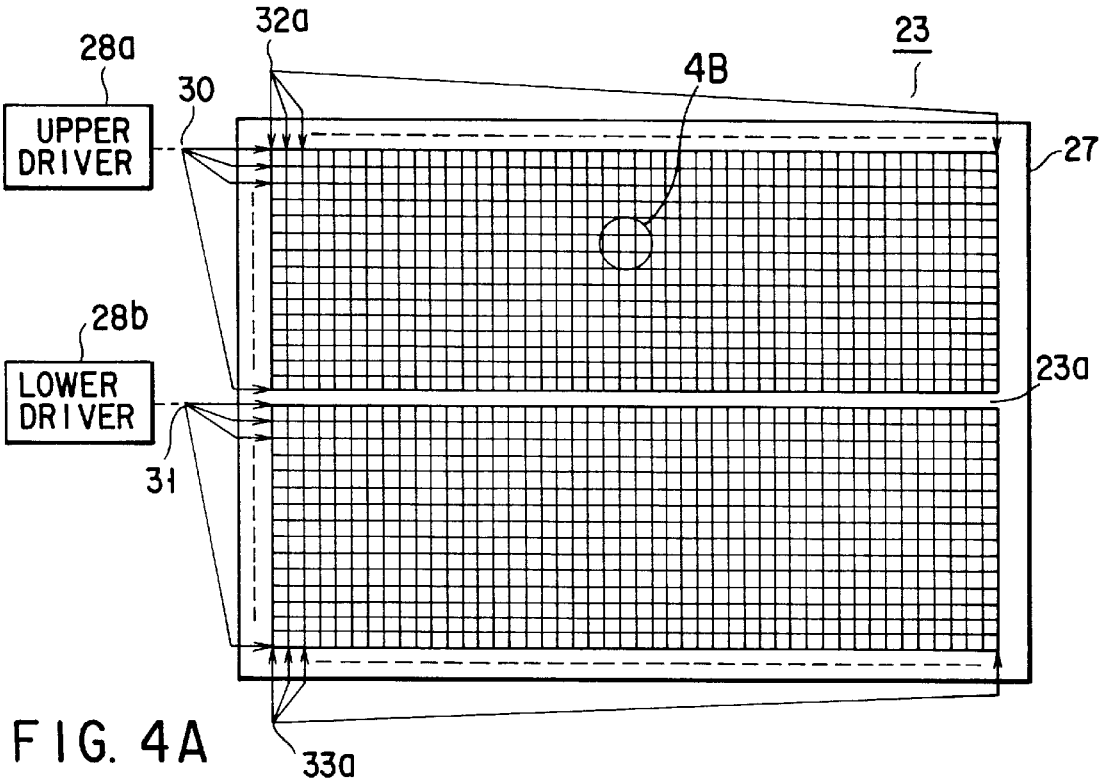
FIG. 4A is a schematic plan view of an array substrate in a liquid crystal display device in accordance with a second embodiment of the present invention.
Figure 4B:
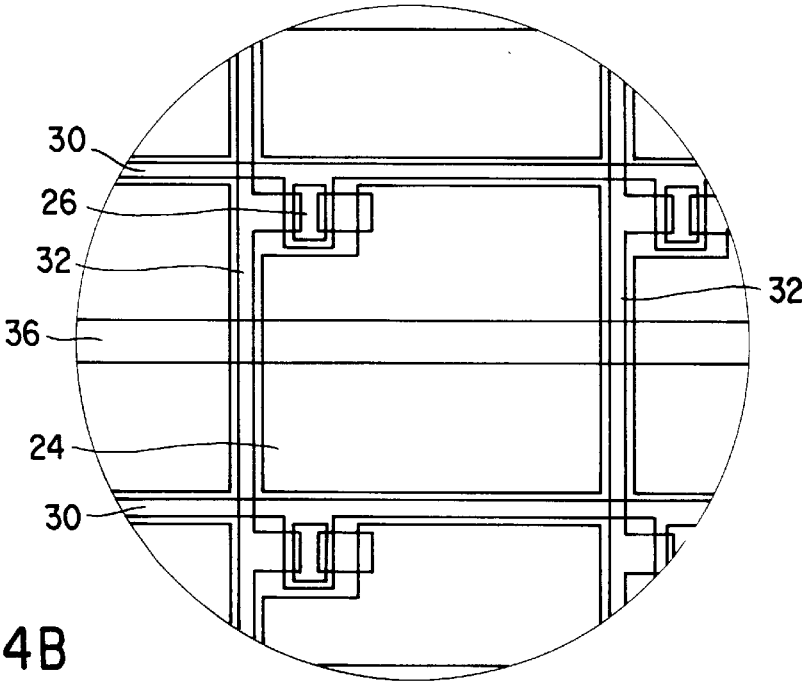
FIG. 4B is an enlarged plan view of circle 4B of FIG. 4A that corresponds to one pixel in the liquid crystal display device.

FIG. 3 shows scanning line driving waveforms for the equivalent circuit of FIG. 2. In FIG. 3, it is assumed that the number n of scanning lines that are reset simultaneously when a row (scanning line) is selected is 3, the number m of blank intervals between the final reset pulse and a write pulse is 2, and the reset voltage is equal to the common voltage. The interval between dotted lines corresponds to the 1H time, which is the result of one frame time divided by the total number of scanning lines (the total number of rows). R denotes a reset pulse, B a blank, and S a write pulse.

With this driving method, it is possible to perform a reset operation by a second scanning line 17 driven by the second driver system 14*b* simultaneously with a write operation by a first scanning line 16 driven by the first driver system 14*a*. That is, a reset operation for the line SBi (even-numbered row) by a reset pulse R is performed simultaneously with a write operation for the line SAi−1 (odd-numbered row) by a write pulse S. Likewise, a reset operation is performed simultaneously for each of two other even-numbered rows (SBi+1, SBi+2) not shown.

With image display on such a liquid crystal display device of the present embodiment, a contrast ratio as high as 30:1 was obtained. The elimination of the step response enabled a high image quality to be achieved without the occurrence of any afterimage and any flicker. When image display was performed under the same conditions as above except that applied voltages by the signal lines 18 and 20 were inverted with each frame, a good contrast was achieved and no flicker was observed.

According to such an arrangement as described above, at the same time the line SAi−1 is written in by the first scanning line 16 driven by the first driver system 14*a*, an operation of resetting the line SBi and two other even-numbered lines SBi+1, SBi+2, which are to be written in later, is performed by the second scanning lines 17 driven by the second driver system 14*b*. In this way, for an arbitrary line, reset operations are first performed by multiple reset pulses and then a write operation is performed. Moreover, the reset operations can be performed by a driver separate from that for the write operation. The reset operations can be performed without the expense of the write time for the write operation and multiple lines can be reset simultaneously.

For an arbitrary line, therefore, a sufficient reset operation and a subsequent write operation based on a sufficient write time can be performed, which prevents the holding voltage from lowering due to poor writing in. A good holding voltage can be obtained without raising the applied voltage. The resetting prior to writing allows the step response to be eliminated, increasing image contrast. Further, no afterimage due to residual hysteresis is produced and no image sticking and no flicker occur, thus improving image display quality.

Although the signal lines are divided into two groups and two scanning line driver systems are used, the number of TFTs used remains unchanged, checking a reduction in manufacturing yield and an increase in manufacturing cost to a minimum. Because the scanning lines 16 and 17 are respectively driven by the first and second driver systems 14*a* and 14*b*, it becomes easy to perform the horizontal line inversion driving that is suitable as a measure against flicker. The numerical aperture of the display device will be reduced by placing two signal lines (one of the first signal lines and one of the second signal lines) side by side between adjacent arrays of pixels as described above. A reduction in the numerical aperture will be checked by, for example, placing the first and second signal line groups on two separate substrates and stacking each of the substrates on top of the other with the two signal lines aligned with each other.

[Second Embodiment]

A second embodiment of the liquid crystal display device of the present invention will be described with reference to FIGS. 4A, 4B, 5 and 6. The display device of the second embodiment is substantially the same as that of the first embodiment except for the structure of the array substrate. An array substrate, generally indicated at 23, comprises a glass substrate 27 which is formed on top with pixel electrodes 24 arranged in a 640×480 matrix and TFTs 26 serving as switching elements for driving the respective pixel electrodes. The array substrate 23 is opposed to a color-filter substrate (not shown) to sandwich therebetween a thresholdless antiferroelectric liquid crystal material A (the same material as used in the first embodiment) having a spontaneous polarization of 150 nC/cm$^2$, a response time of 100 microseconds, and, a saturation voltage of five volts (Fukuda, Asia Display '95 digest, 61 (1995)), thereby making up a liquid crystal display device.

On the glass substrate 27 of the array substrate 23 are arranged upper scanning lines 30 driven by an upper driver system 28*a* and lower scanning lines 31 driven by a lower driver system 28*b*. Further, signal lines are divided into upper and lower groups with median strip 23*a* as the boundary in such a way that upper signal lines 32 forming an upper signal line group 32*a* are arranged to intersect the upper scanning lines 30, and lower signal lines 33 forming a lower signal line group 33*a* are arranged to intersect the lower scanning lines 31.

In the vicinity of each of intersections of scanning lines 30 (31) and signal lines 32 (33) is placed a TFT 26 with which a pixel electrode 24 is electrically connected. The pixel electrodes 24*a* in the upper half section are driven by the upper driver system 28*a*, while the pixel electrodes 24*b* in the lower half section are driven by the lower driver system 28*b*. That is, the upper pixel electrodes 24*a* and the lower pixel electrodes 24*b* can be driven independently. Reference numeral 36 denotes a storage capacitor line.

Figure 5:
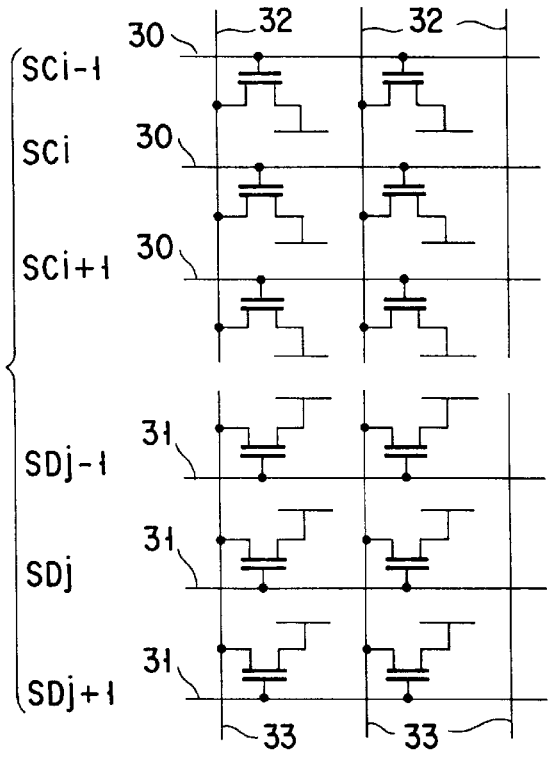
FIG. 5 is an equivalent circuit diagram of a portion of the array substrate of the second embodiment.

Reference is next made to FIG. 5 illustrating an equivalent circuit of a portion of the array substrate 23 to describe the driving method for the liquid crystal display device thus arranged. In FIG. 5, the storage capacitor line 36 is omitted. The driver system for the TFTs in the array substrate is the same as the VGA driver system. That is, the upper and lower signal lines provide the horizontal line inversion driving with a maximum applied voltage of ±6 volts, and the upper and lower scanning lines provide a horizontal line scan in a 1H time of 32 microseconds.

Figure 6:
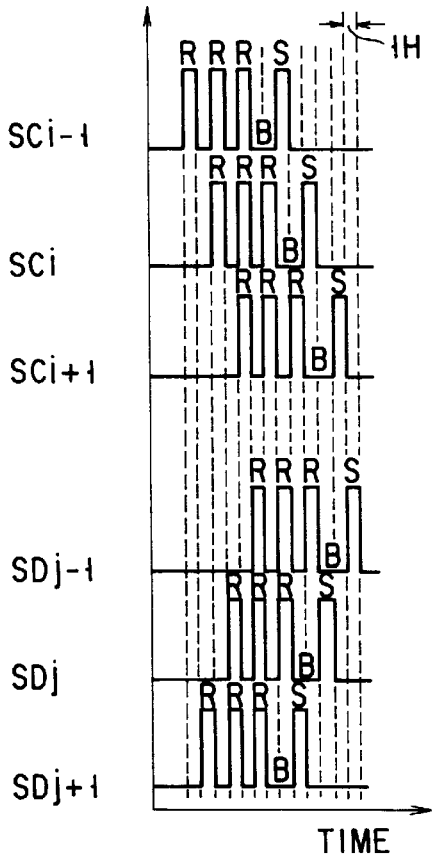
FIG. 6 is a timing diagram of scanning line driving waveforms for the scanning lines in FIG. 5.

As is understood from scanning line driving waveforms shown in FIG. 6, the present driving method assumes that the number n of scanning lines that are reset simultaneously when an arbitrary row (scanning line) is selected is set to 3, the number m of blank intervals present between the final reset pulse R and a write pulse S is set to 2, and the reset voltage is equal in potential to the common voltage. That is, writing into an arbitrary row and resetting of three other rows are performed simultaneously.

In more detail, reset operations of lower scanning lines 31 driven by the lower driver system 28*b* can be performed simultaneously with a write operation of an upper scanning line 30 driven by the upper driver system 28*a*. At the time when a write operation of the scanning line SCi−1 of FIG. 5 is performed by a write pulse S on the scanning line SCi−1 of FIG. 6, the scanning lines SDj−1 and SDj of FIG. 5 are reset by reset pulses R on the scanning lines SDj−1 and SDj of FIG. 6. At the same time, another scanning line SDj−2 not shown is also reset.

With the liquid crystal display device of the second embodiment thus arranged, a good contrast ratio of 30:1 was obtained. The elimination of the step response provided afterimage- and flicker-free image display. Further, since a single signal line is placed between adjacent pixel electrodes 34, the aperture ratio is increased by 15% in comparison with the first embodiment. Thus, the use of the same backlight allowed display brightness to be improved in comparison with the first embodiment. However, after a long-term endurance test, some display devices showed a boundary line slightly on the median strip 23*a* of the array substrate 23.

With such an arrangement, any scanning line can perform a write operation after reset operations by reset pulses. And moreover the reset operations can be performed without sacrificing the write time for a write operation and multiple scanning lines can be reset simultaneously. Thus, a good holding voltage can be obtained in any scanning line without raising the applied voltage as in the first embodiment by sufficient reset operations and a subsequent write operation based on a sufficient write time. The resetting prior to writing allows afterimage due to the step response to be eliminated, which offers improvements in contrast and image quality.

Although two signal lines are arranged for each column and the scanning driving system is divided into two, a signal line for one pixel is anyone of 32 and 33, the aperture ratio is not reduced, a good display brightness is obtained, the manufacturing yield is not reduced, and the manufacturing cost is not increased.

In contrast, as an example 1 for comparison, a liquid crystal display device was prepared in which a conventional array substrate arranged such that a TFT and a signal line is provided for each pixel electrode is used, scanning lines are driven by a single driver system, and the other conditions are the same as those in the first embodiment. For image display with no reset operation, the liquid crystal display device provided a contrast ratio as low as 10:1 and showed afterimage due to the step response. It was thus confirmed that the display quality of that display device is inferior to that of the display device of the first embodiment.

As an example 2 for comparison, use was made of the same liquid crystal display device as that in the example 1 for comparison and image display was made with the first half of the write time for one scanning line allocated for a reset operation. In this case, since the step response was eliminated, neither afterimage nor flicker was observed, but the contrast ratio was so low as 20:1. Thus, no good display quality was obtained.

[Third Embodiment]

A third embodiment of the present invention will be described next. In the third embodiment, the liquid crystal material used in the display device of the first embodiment is replaced with deformed helix ferroelectric liquid crystal (hereinafter referred to as DHF liquid crystal) B having a spontaneous polarization of 150 nC/cm$^2$, a response time of 100 microseconds, and a saturation voltage of 5 volts. As in the first embodiment, the driving system is equivalent to the VGA driving system in which horizontal line inversion driving is performed with a maximum applied voltage of ±6 volts and the 1H time is 32 microseconds. The number n of scanning lines that are reset simultaneously when a row is selected is set to 2, and the number m of blank intervals between the final reset pulse and a write pulse is set to 2.

The DHF liquid crystal B is distinct from the liquid crystal A used in the first embodiment in that its applied voltage versus light transmission curve is asymmetrical with respect to 0 volts, and it is faster in response speed than A.

According to image display by the display device of the present embodiment in the same way as the display device of the first embodiment is driven, a contrast ratio as high as 30:1 was obtained. Further, no afterimage is produced because the step response is eliminated, and no flicker is observed because of the effect of horizontal line inversion, thus providing high display quality.

The third embodiment thus arranged can provide the same advantages as the first embodiment with a reduction in manufacturing yield and an increase in manufacturing cost checked to a minimum. That is, for a scanning line, after a reset operation has been performed, a write operation can be performed in a sufficient write time, preventing the holding voltage lowering. The elimination of the step response by resetting prior to writing offers improved image display with no afterimage and no flicker. In addition, the display contrast is also improved.

As an example 3 for comparison, a liquid crystal display device was prepared in which the liquid crystal material is replaced with deformed helix ferroelectric liquid crystal B having a spontaneous polarization of 150 nC/cm$^2$, a response time of 100 microseconds, and a saturation voltage of five volts. The TFT driving system was used which is equivalent to the VGA driving system in which frame inversion driving with a maximum applied voltage of ±6 volts is performed and the 1H time is 32 microseconds. The settings were made such that the number n of scanning lines that are reset simultaneously when a row is selected is 2, and the number m of blank intervals between the final reset pulse and a write pulse is 2. When driven in the same way as the display device of the second embodiment is driven, this display device showed a contrast ratio of 30:1. However, although no afterimage was produced owing to elimination of the step response, flicker was observed.

Figure 7:
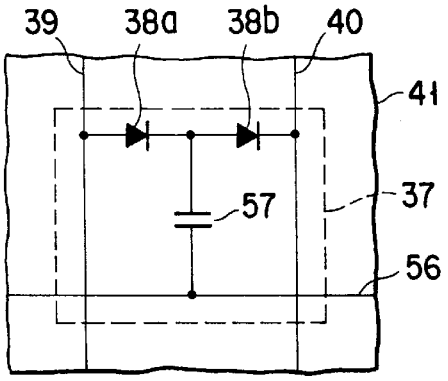
FIG. 7 is an equivalent circuit diagram of an array substrate in a liquid crystal display device in example 4 for comparison.

As an example 4 for comparison, a liquid crystal display device was prepared in which, as shown in FIG. 7, one pixel 37 is provided with two TFDs 38*a* and 38*b*, which are associated with a data line 39 for writing in data, a reference line 40 for resetting, a scanning line 56, and a pixel electrode 57, formed on an array substrate 41. Except for this pixel arrangement, this display device was prepared under the same conditions as that of the first embodiment.

The image display under the driving conditions in which resetting is followed by writing showed a contrast ratio of 30:1. Although no afterimage was produced owing to elimination of the step response, variations in characteristics of the TFDs 38*a* and 38*b* from pixel to pixel produced unevenness in display. The arrangement of this example will increase manufacturing cost because of provision of two switching devices and two signal lines. Further, there arises the possibility that a reduction in manufacturing yield may result in an increase in manufacturing cost. In addition, a reduction in aperture ratio results in a decrease in display brightness.

[Fourth Embodiment]

Figure 8:
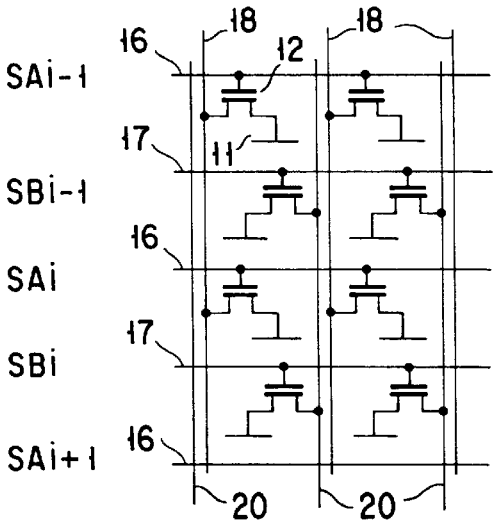
FIG. 8 is an equivalent circuit diagram of a portion of an array substrate of a fourth embodiment of the present invention.

A fourth embodiment of the present invention will be described next with reference to FIGS. 8 and 9. In this embodiment, the liquid crystal display device of the first embodiment is used, a write operation is performed during a time interval of 2H, which is twice the write time in the first embodiment, instead of performing a reset operation, and a precharge operation is performed during a time interval of 0 to 2H immediately before the write operation. That is, since the display device of the first embodiment uses two driving systems for the scanning lines 16 and 17, the write time for each scanning line can be doubled in comparison with the case where a single driving system is used for an equal number of scanning lines. Thus, as shown in FIG. 9, all the 2H time can be used as a write time.

With such an arrangement, all the write time can be employed to write in desired data in comparison with overlap scanning in which the first half of the write time is employed to utilize other line data. Thus, a reduction in the holding voltage due to poor writing will never occur. Without resetting, the step response can be eliminated, so that no afterimage is produced and the contrast is improved. In comparison with the overlap scanning, crisp images with no blurring can be obtained.

For liquid crystal materials whose response time for any change between the lowest and highest gray levels is less than 2H, it may be preferable to use the driving method which is allowed to double the write time without performing any reset operation.

Figure 9:
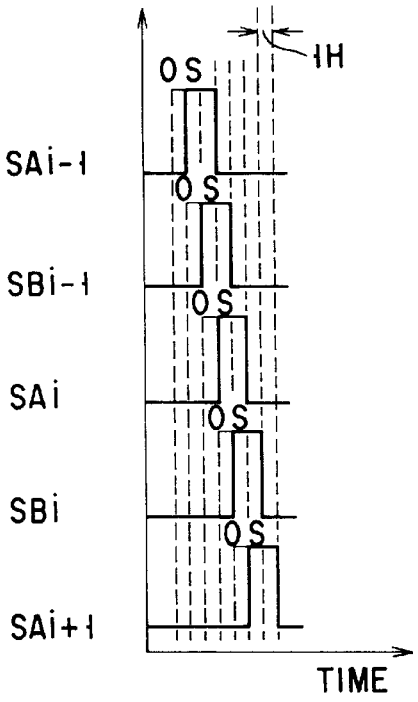
FIG. 9 is a timing diagram of scanning line driving waveforms for the scanning lines in FIG. 8.

If the scanning line write time is doubled, and, like the overlap scanning, precharging is performed during a 1H time interval immediately before writing as indicated by broken lines O in FIG. 9, crisper images than with normal overlap scanning will be obtained because sufficient data writing is allowed following the precharging. This driving method is particularly useful for liquid crystal materials in which that response time is less than 3H, not less than 2H.

[Fifth Embodiment]

Figure 10:
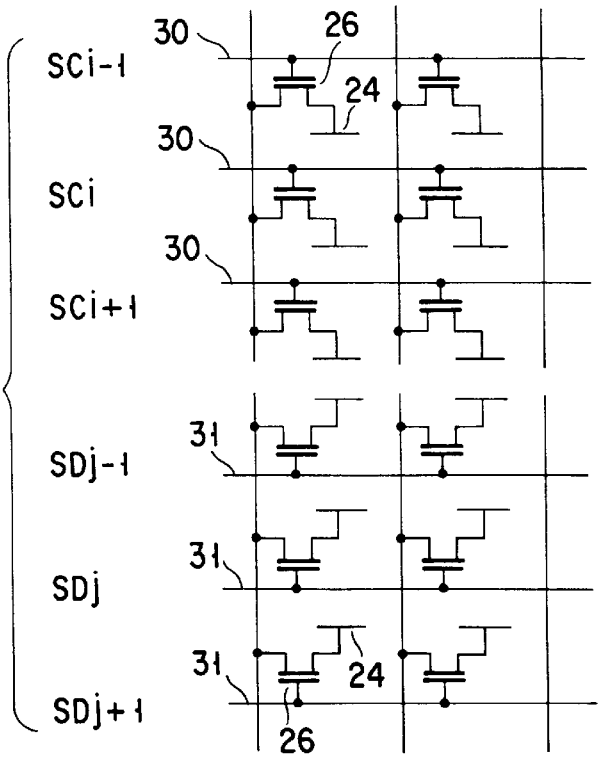
FIG. 10 is an equivalent circuit diagram of a portion of an array substrate according to a fifth embodiment of the present invention.
Figure 12A:
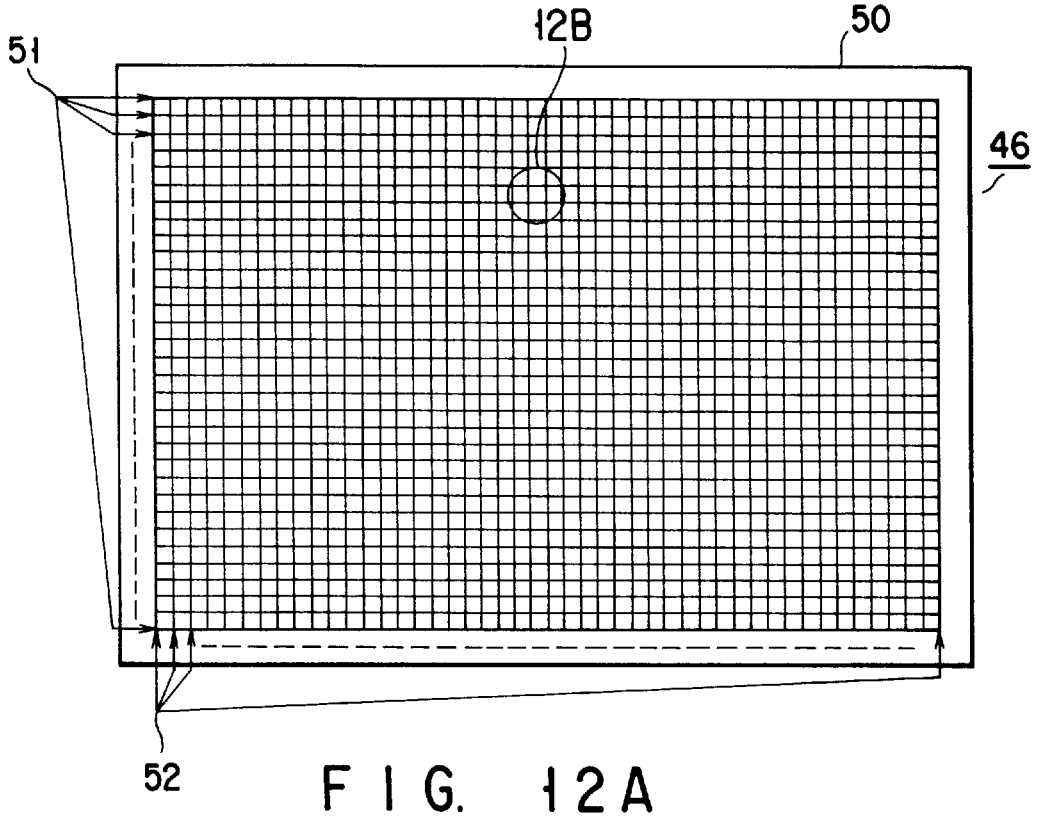
FIG. 12A is a schematic plan view of an array substrate in a liquid crystal display device in accordance with a sixth embodiment of the present invention.
Figure 12B:
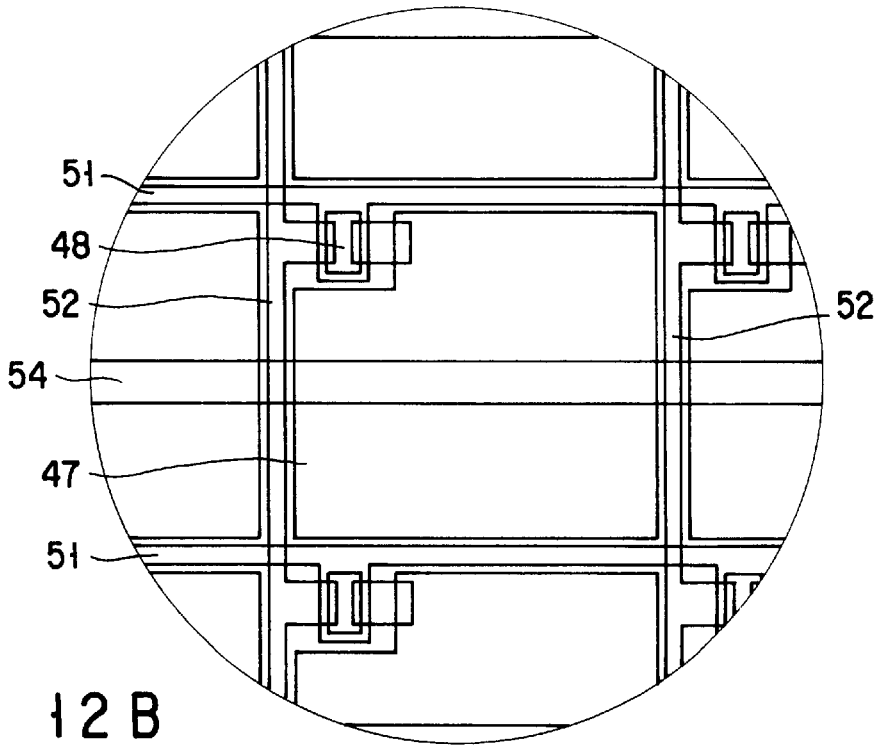
FIG. 12B is an enlarged plan view of circle 12B of FIG. 12A that corresponds to one pixel in the liquid crystal display device.

A fifth embodiment of the present invention will be described next with reference to FIGS. 10 and 11. In this embodiment, the liquid crystal display device of the second embodiment is used, a write operation is performed during a time interval of 2H, which is twice the write time in the second embodiment, instead of performing a reset operation, and a precharge operation is performed during a time interval of 0 to 2H immediately before the write operation. That is, since the display device of the second embodiment uses two driving systems for the scanning lines 30 and 31, the write time for each scanning line can be doubled as with the fourth embodiment. Thus, as shown in FIG. 11, all the 2H time can be used as a write time.

With such an arrangement, like the fourth embodiment, crisp images with no blurring can be obtained in comparison with the overlap scanning, Depending on liquid crystal materials, it may be preferable to use the driving method which is allowed to double the write time without performing any reset operation.

Figure 11:
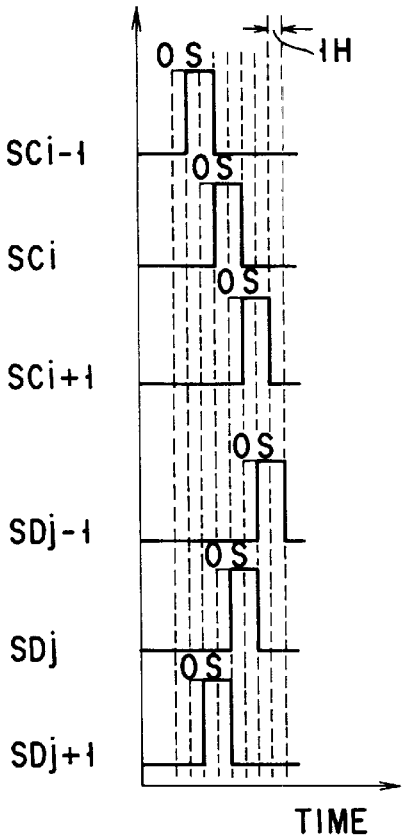
FIG. 11 is a timing diagram of scanning line driving waveforms for the scanning lines in FIG. 10.

If the scanning line write time is doubled, and, like the overlap scanning, precharging is performed during a 1H time interval immediately before writing as indicated by broken lines O in FIG. 11, it will become possible to obtain crisper images than with normal overlap scanning.

[Sixth Embodiment]

A sixth embodiment of the liquid crystal display device of the present invention will be described with reference to FIGS. 12A, 12B, 13, and 14. An array substrate, generally indicated at 46, comprises a glass substrate 50 which is formed on top with pixel electrodes 47 arranged in a 640×480 matrix and TFTs 26 serving as switching elements for driving the respective pixel electrodes. The array substrate 46 is opposed to a color-filter substrate (not shown) to sandwich therebetween a thresholdless antiferroelectric liquid crystal material A having a spontaneous polarization of 150 nC/cm$^2$, a response time of 100 microseconds, and a saturation voltage of five volts as with the first embodiment, thereby making up a liquid crystal display device.

On the glass substrate 50 comprising the array substrate 46 scanning lines 51 and signal lines 52 are arranged in a matrix form and a TFT 48 is formed in the vicinity of each of their intersections. A pixel electrode 47 is electrically connected to an end of the TFT 48, and the signal lines 52 are involved in sequence by the scanning lines 51 which, in turn, are driven by a single driving system. Reference numeral 54 denotes a storage capacitor line.

Figure 13:
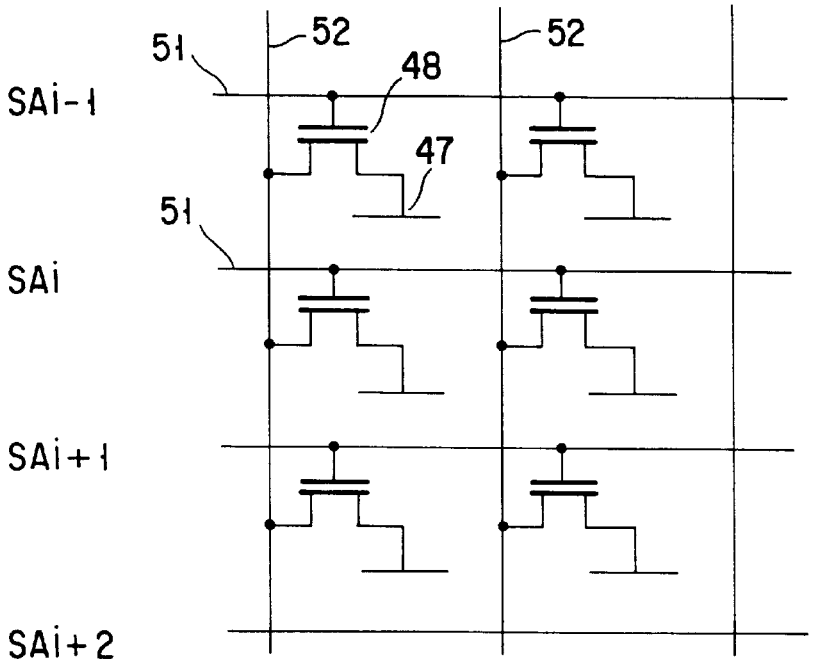
FIG. 13 is an equivalent circuit diagram of a portion of the array substrate of the sixth embodiment.

Reference is next made to FIG. 13 illustrating an equivalent circuit of a portion of the array substrate 46 to describe the driving method for the liquid crystal display device thus arranged. In FIG. 13, the storage capacitor line is omitted. The TFT driver system of this display device is equivalent to the VGA driver system in which a maximum applied voltage by the signal lines 52 is ±6 volts, and the 1H time is 32 microseconds.

Figure 14:
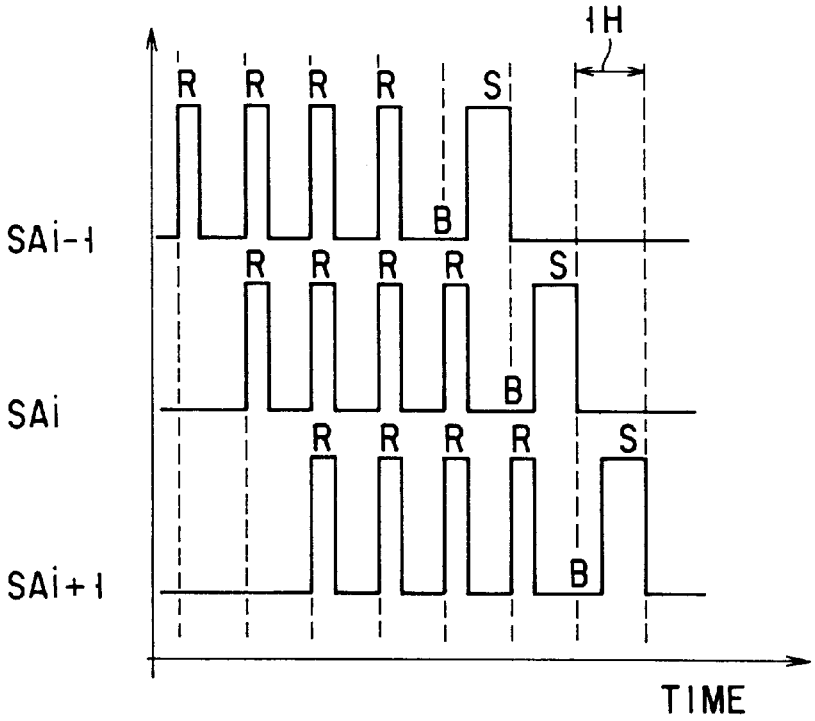
FIG. 14 is a timing diagram of scanning line driving waveforms for the scanning lines in FIG. 13.

As is understood from scanning line driving waveforms shown in FIG. 14, one third of 1H time is allocated for reset interval, the number n of scanning lines that are reset simultaneously is set to 4, the number m of blank intervals present between the final reset pulse and a write pulse is set to 1, the reset voltage is set equal in potential to the common voltage, and plural pixels of multiple rows are simultaneously reset. Taking into account the fact that the rise time of the TFT 48 is about three microseconds, adjustments are made in such a way as to make both the write pulse S and the reset pulse R start several microseconds earlier.

That is, before a row is written into by a scanning line 51, it is reset several times at the same time some other rows are reset. For the scanning line SAi−1 of FIG. 13, four reset operations are performed over four lines prior to writing by a write pulse S. Each reset operation is performed in ⅓ of the 1H time. Using ⅓ of the 1H time during which writing by the scanning line ASi−1 is performed, a reset operation is performed on a total of four lines SAi, SAi+1, SAi+2, and SAi+3 (not shown).

According to the display device of the sixth embodiment, good image display with a contrast ratio of 30:1 can be obtained. The step response is also eliminated, so that no afterimage is produced.

With such an arrangement, each scanning line is reset four times before it is written into. Each reset interval is equal to ⅓ of the 1H time. Even if each reset interval is short, a total of four reset intervals is long enough to ensure resetting. Thus, it becomes possible to obtain a good holding voltage without raising the applied voltage. The resetting prior to writing allows the step response to be eliminated, thus improving display contrast and avoiding the occurrence of flicker.

In addition, use can be made of a conventional array substrate in which one TFT 48 and one signal line 52 are allocated for each pixel electrode 47 and scanning lines are driven in sequence by a single driving system. This prevents an increase in cost due to an increase in the number of switching elements and lines. An increase in cost due to a reduction in manufacturing yield will be prevented.

As an example 5 for comparison, a display device which is the same as that of the sixth embodiment, but is driven with no resetting produced a contrast ratio as low as 10:1. Afterimage due to the step response was also produced.

As an example 6 for comparison, use was made of a liquid crystal display device which is the same as that of the sixth embodiment and driven in the conventional manner in which ⅓ of the 1H time is allocated for a reset operation and a reset operation is performed immediately before a write operation for a selected line. According to image display of this display device, afterimage was produced slightly although the step response was eliminated, and the contrast ratio was improved only up to a level of 20:1.

[Seventh Embodiment]

A seventh embodiment of the present invention will be described next. In the seventh embodiment, the liquid crystal material used in the display device of the sixth embodiment is replaced with DHF liquid crystal B having a spontaneous polarization of 150 nC/cm$^2$, a response time of 100 microseconds, and a saturation voltage of 5 volts. As with the sixth embodiment, the driving system used is equivalent to the VGA driving system in which horizontal line inversion driving is performed with a maximum applied voltage of ±6 volts and the 1H time is 32 microseconds. One-third of the 1H time is allocated for a reset interval, the number n of scanning lines that are reset simultaneously is set to 2, and the number m of blank intervals between the final reset pulse and a write pulse is set to 1. When the display device of the present embodiment is driven in such a way that multiple scanning lines are reset simultaneously, a contrast ratio as high as 30:1 was obtained. Further, no afterimage was produced because of the elimination of the step response.

As with the sixth embodiment, in the present embodiment, even if each reset interval is short, a total of reset intervals becomes long enough to ensure resetting. Thus, it becomes possible to obtain a good holding voltage without raising the applied voltage. The resetting prior to writing allows the step response to be eliminated, thus improving display contrast and avoiding the occurrence of flicker.

Next, as an example 7 for comparison, the liquid crystal display device of the seventh embodiment was used under the driving conditions such that one-tenth of the 1H time is allocated for a reset interval, the number n of scanning lines that are reset simultaneously is set to 2, and the number m of blank intervals between the final reset pulse and a write pulse is set to 2. In this case, a total of reset intervals was too short to ensure resetting. Thus, afterimage due to the step response was produced, and the contrast ratio was reduced down to 25:1.

Although the preferred embodiments of the present invention have been described and disclosed, the present invention may be practiced or embodied in still other ways without departing the scope and spirit thereof. For example, in the first, second and third embodiments, the number n of scanning lines that are reset simultaneously and the number m of blank intervals may be set arbitrarily. However, the simultaneous resetting of too many scanning lines may cause the reset state to appear on a display image. For this reason, the number n of scanning lines that are reset simultaneously should be set so as not to adversely affect display image. It is preferable that the number n of scanning lines be within a range of 1 to 10, and the number m of blank intervals be 0, 2, or 4.

With the sixth and seventh embodiments, it is required that the number n of scanning lines that are reset simultaneously and the number m of blank intervals be set so that no reset state will appear on display image, and a total of reset intervals be long enough to ensure resetting. Further, a portion of the write time that is allocated for a reset operation needs to be set so as not to affect a write operation. It is therefore preferable that the number n of scanning lines be within a range of 1 to 10, the number m of blanks be within a range of 0 to 3, and the reset interval be allocated to ⅙ to ½ of the 1H time.

A temperature range over which liquid crystal display devices are used is from 0 to 50° C. Within this range of temperature, the liquid crystal materials have some temperature dependence in response speed. If the number n of scanning lines and the number m of blank intervals are fixed, display images may become to be degraded, depending on the temperature. Thus, temperature sensor means and control means responsive to the temperature sensor means to automatically adjust the number n of scanning lines or the number m of blank intervals may be provided to ensure that good images are obtained independently of temperature. Alternatively, the number n of scanning lines or the number m of blank intervals may be adjusted manually with a control knob.

Figure 15A:
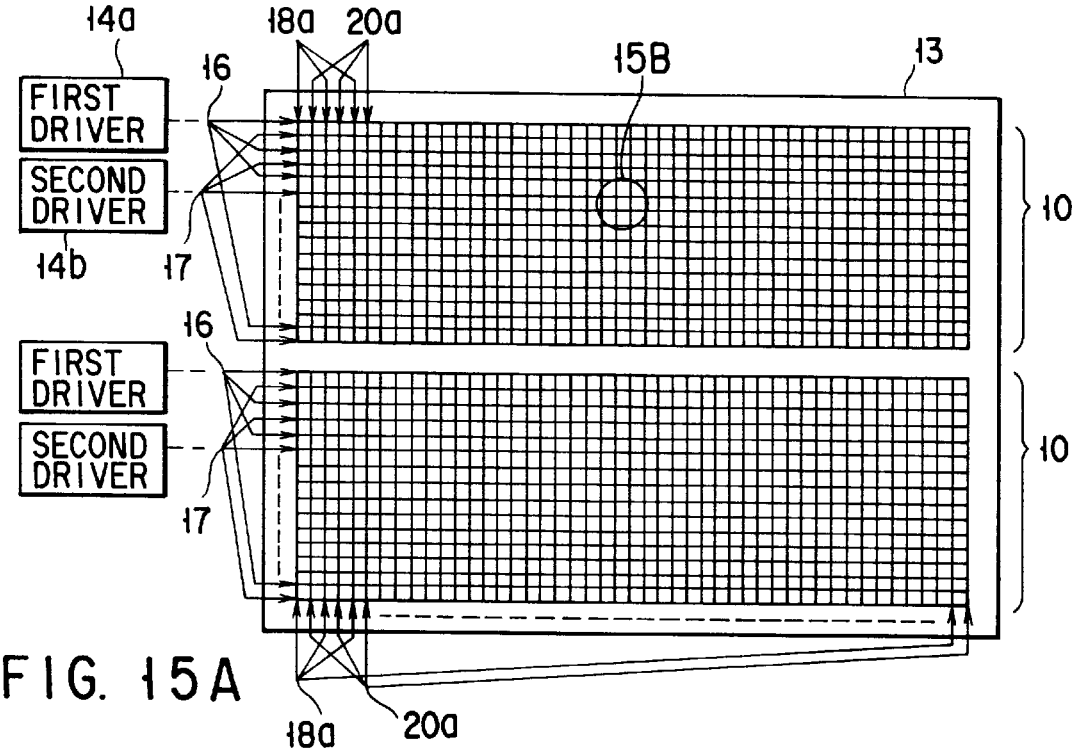
FIG. 15A is a schematic plan view of an array substrate in an application of the present invention.
Figure 15B:
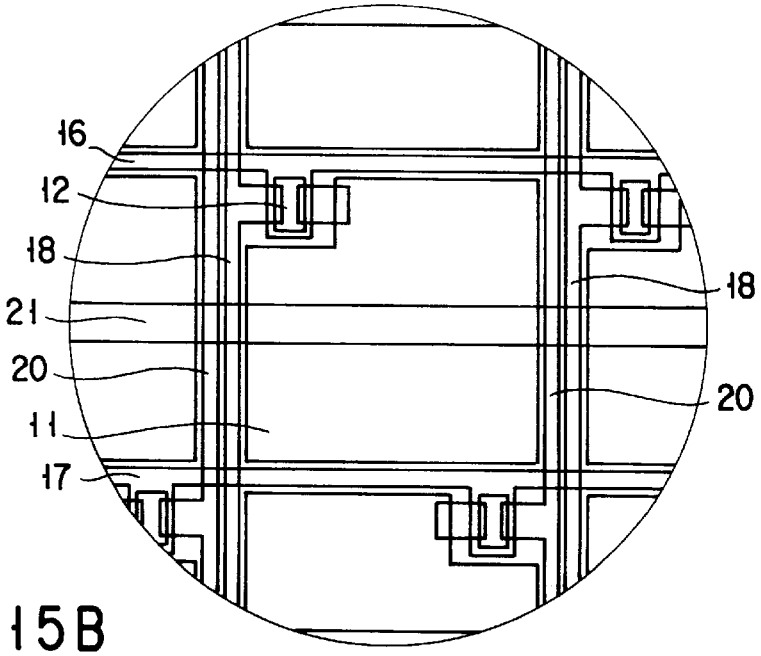
FIG. 15B is an enlarged plan view of circle 15B of FIG. 15A that corresponds to one pixel in a liquid crystal display device.

A larger display device can be provided by arranging two liquid crystal display devices as used in the first embodiment one above the other as shown in FIG. 15. To realize a large screen with high definition with the use of a single liquid crystal display device, the number of lines has to be increased, which requires the one-line write time to be shortened. Since it is difficult to improve the response speed of liquid crystal materials, the write time cannot be shortened much. Thus, by arranging two liquid crystal display devices one above the other to provide two-screen driving, the number of lines can be doubled without shortening the write time, which allows large-screen, high-definition liquid crystal display devices to be realized.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A liquid crystal display device comprising:

a first substrate having a first major surface;

a plurality of pixel electrodes arranged in rows and columns on the first major surface of the first substrate;

a plurality of switching elements each having a conduction path and a control terminal adapted to control conduction of the conduction path, an end of the conduction path of each of the switching elements being connected to a corresponding one of the pixel electrodes;

a second substrate having a second major surface that is opposed to the first major surface of the first substrate;

a common electrode formed on the second major surface of the second substrate and opposed to the pixel electrodes;

a liquid crystal material with spontaneous polarization sandwiched between the first major surface of the first substrate and the second major surface of the second substrate;

a plurality of signal lines arranged on the first major surface of the first substrate substantially parallel with one another along the columns and formed so as to correspond with the respective columns, each of the signal lines being connected to the other end of the conduction path of each of selected elements of the switching elements arranged along a corresponding one of the columns;

a plurality of scanning lines arranged on the first major surface of the first substrate substantially parallel with one another along the rows, each of the scanning lines being connected to the control terminals of the switching elements arranged along a corresponding one of the rows; and a driver for driving the plurality of scanning lines, wherein the driver provides scan-signals to the plurality of scanning lines to repeat two operation modes of a first and a second mode alternately, the first mode being a mode in which reset pulses are provided to selected ones of the plurality of scanning lines simultaneously to reset respective holding voltages thereof to a preset voltage, and the second mode being a mode in which a writing pulse is provided to a selected one of the plurality of scanning lines.

2. The liquid crystal display device according to claim 1, wherein the plurality of signal lines are divided into a plurality of signal line bundles, each of the signal line bundles comprising a predetermined number of the signal lines and the driver dedicated thereto.

3. The liquid crystal display device according to claim 2, wherein the signal lines in each of the signal line bundles comprise first signal lines connected to the switching elements in odd-numbered rows, respectively, and second signal lines connected to the switching elements in even-numbered rows, respectively, and the driver is provided for performing write and reset operations through the switching elements for each of the odd-numbered rows and the even numbered rows.

4. The liquid crystal display device according to claim 2, wherein the first substrate is divided into a plurality of display sections, and wherein, in each of the display sections, the signal lines in each of the signal line bundles comprise first signal lines connected to the switching elements in odd-numbered rows, respectively, and second signal lines connected to the switching elements in even-numbered rows, respectively and the driver is provided for performing write and reset operations through the switching elements for each of the odd-numbered rows and the even-numbered rows.

5. The liquid crystal display device according to claim 1, wherein each of the switching elements is a thin film transistor.

6. A method of driving a liquid crystal display device comprising the steps of:

preparing a liquid crystal display device comprising:

a first substrate having a first major surface;

a plurality of pixel electrodes arranged in rows and columns on the first major surface of the first substrate;

a plurality of switching elements each having a conduction path and a control terminal adapted to control conduction of the conduction path, an end of the conduction path of each of the switching elements being connected to a corresponding one of the pixel electrodes;

a second substrate having a second major surface that is opposed to the first major surface of the first substrate;

a common electrode formed on the second major surface of the second substrate and opposed to the pixel electrodes;

a liquid crystal material with spontaneous polarization sandwiched between the first major surface of the first substrate and the second major surface of the second substrate;

a plurality of signal line bundles arranged on the first major surface of the first substrate substantially parallel with one another along the columns and formed so as to correspond with the respective columns, each of the signal line bundles comprising a predetermined number of signal lines and each of the signal lines of one of the signal line bundles being connected to the other end of the conduction path of each of selected elements of the switching elements arranged along a corresponding one of the columns;

a plurality of scanning lines arranged on the first major surface of the first substrate substantially parallel with one another along the rows, each of the scanning lines being connected to the control terminals of the switching elements arranged along a corresponding one of the rows;

and a plurality of drivers each for driving a predetermined number of scanning lines of the plurality of scanning lines, the drivers corresponding in number to the signal lines of each of the signal line bundles and each of the drivers driving corresponding scanning lines each of which is connected to the control terminals of the selected elements of the switching elements;

allowing each of the drivers to perform a write operation of an arbitrary one of the corresponding predetermined number of scanning lines and a reset operation of at least two of the scanning lines to reset a holding voltage thereof to a preset voltage, to repeat the write operation and the reset operation alternately.

7. The driving method according to claim 6, wherein the step of allowing each of the drivers to perform a write operation and a reset operation includes a step wherein the number of scanning lines that are reset simultaneously with the write operation ranges from 1 to 10, and, for each of the scanning lines, a blank interval t between a final reset pulse for the reset operation and a write pulse for the write operation is set to anyone of 0, 2T/n, and 4T/n where T is one frame time, and n is a total number of the scanning lines.

8. The driving method according to claim 7, further comprising the step of adjusting the number of scanning lines that are reset simultaneously and the blank interval.

9. The driving method according to claim 6, wherein the predetermined number of signal lines includes first signal lines connected to the switching elements in odd-numbered rows and second signal lines connected to the switching elements in even-numbered rows, and the step of allowing each of the drivers to perform a write operation and a reset operation includes a step in which one of the drivers performs a write operation on one of scanning lines in odd-numbered rows at the same time another of the drivers performs a reset operation on at least two of scanning lines in even-numbered rows, and the another of the drivers performs a write operation on one of scanning lines in even-numbered rows at the same time the one of the drivers performs a reset operation on at least two of scanning lines in odd-numbered rows.

10. The driving method according to claim 9, the step of allowing each of the drivers to perform a write operation and a reset operation includes a step wherein the number of scanning lines that are reset simultaneously with the write operation ranges from 2 to 10, and, for each of the scanning lines, a blank interval t between a final reset pulse for the reset operation and a write pulse for the write operation is set to anyone of 0, 2T/n, and 4T/n where T is one frame time, and n is a total number of the scanning lines.

11. The driving method according to claim 10, wherein the step of allowing each of the drivers to perform a write operation and a reset operation includes a step of adjusting the number of scanning lines that are reset simultaneously and the blank interval.

12. The driving method according to claim 6, wherein the predetermined number of signal lines includes first signal lines connected to the switching elements in the upper half section of the first substrate and second signal lines connected to the switching elements in the lower half section of the first substrate, and the step of allowing each of the drivers to perform a write operation and a reset operation includes a step in which one of the drivers performs a write operation on one of scanning lines on the upper half section of the first substrate at the same time another of the drivers performs a reset operation on at least two of scanning lines in the lower half section of the first substrate, and the another of the drivers performs a write operation on one of scanning lines in the lower half section of the first substrate at the same time the one of the drivers performs a reset operation on at least two of scanning lines in the upper half section of the first substrate.

13. The driving method according to claim 12, wherein the step of allowing each of the driver to perform a write operation and a reset operation includes a step wherein the number of scanning lines that are reset simultaneously with the write operation ranges from 2 to 10, and, for each of the scanning lines, a blank interval t between a final reset pulse for the reset operation and a write pulse for the write operation is set to anyone of 0, 2T/n, and 4T/n where T is one frame time, and n is a total number of the scanning lines.

14. The driving method according to claim 13, wherein the step of allowing each of the driver to perform a write operation and a reset operation includes a step of adjusting the number of scanning lines that are reset simultaneously and the blank interval.

15. A method of driving a liquid crystal display device comprising the steps of:

preparing a liquid crystal display device comprising: a first substrate having a first major surface; a plurality of pixel electrodes arranged in rows and columns on the first major surface of the first substrate; a plurality of switching elements each having a conduction path and a control terminal adapted to control the conduction of the conduction path, an end of the conduction path of each of the switching elements being connected to a corresponding one of the pixel electrodes; a second substrate having a second major surface that is opposed to the first major surface of the first substrate; a common electrode formed on the second major surface of the second substrate and opposed to the pixel electrodes; a liquid crystal material of spontaneous polarization sandwiched between the first major surface of the first substrate and the second major surface of the second substrate; a plurality of signal line bundles arranged on the first major surface of the first substrate substantially parallel with one another along the columns and formed so as to correspond with the respective columns, each of the signal line bundles comprising a number k ($k \geqq 2$) of signal lines and each of the k signal lines being connected to the other end of the conduction path of each of selected elements of the switching elements arranged along a corresponding one of the columns; a plurality of scanning lines arranged on the first major surface of the first substrate substantially parallel with one another along the rows, each of the scanning lines being connected to the control terminals of switching elements arranged along a corresponding one of the rows; and a number k of drivers each for driving a predetermined number of scanning lines of the plurality of scanning lines, the drivers corresponding in number to the signal lines of each of the signal line bundles and each of the drivers driving corresponding scanning lines each of which is connected to the control terminals of the selected elements of the switching elements; and allowing each of the drivers to perform a write operation on each of the corresponding scanning lines during a write time of k×T/n where T is one frame time and n is a total number of scanning lines.

16. The driving method according to claim 15, wherein the step of allowing each of the drivers to perform a write operation includes a step of performing precharging of a pixel voltage during a time interval from 0 to k×T/n immediately before the write operation.

17. A method of driving a liquid crystal display device comprising the steps of:

preparing a liquid crystal display device comprising:

a first substrate having a first major surface;

a plurality of pixel electrodes arranged in rows and columns on the first major surface of the first substrate;

a plurality of switching elements each having a conduction path and a control terminal adapted to control conduction of the conduction path, an end of the conduction path of each of the switching elements being connected to a corresponding one of the pixel electrodes;

a second substrate having a second major surface that is opposed to the first major surface of the first substrate;

a common electrode formed on the second major surface of the second substrate and opposed to the pixel electrodes;

a liquid crystal material with spontaneous polarization sandwiched between the first major surface of the first substrate and the second major surface of the second substrate;

a plurality of signal lines arranged on the first major surface of the first substrate substantially parallel with one another along the columns and formed so as to correspond with the respective columns, each of the signal lines being connected to the other end of the conduction path of each of selected elements of the switching elements arranged along a corresponding one of the columns; and a plurality of scanning lines arranged on the first major surface of the first substrate substantially parallel with one another along the rows, each of the scanning lines being connected to the control terminals of the switching elements arranged along a corresponding one of the rows;

performing a write operation on an arbitrary one of the scanning lines;

immediately before performing the write operation on the arbitrary one of the scanning lines, performing a reset operation for resetting a holding voltage to a preset voltage on arbitrary ones of the scanning lines and repeating the reset operation and the write operation alternately.

18. The driving method according to claim 17, wherein the step of performing a reset operation includes a step of performing a plurality of reset operations immediately before the write operation, the time interval for each reset operation being set equal to or less than T/(2n) where T is one frame time and n is a total number of scanning lines, and the step of performing a write operation includes a step in which, immediately after a reset operation of arbitrary ones of the scanning lines is finished, the write operation of the arbitrary one of the scanning lines is started, and a sum of a time interval for the write operation and time intervals for the reset operations is set to T/n.

19. The driving method according to claim 18, wherein the step of performing a reset operation includes a step in which the time interval for each reset operation ranges from T/(6n) to T/(2n), the number of scanning lines that are reset simultaneously with the write operation ranges from 2 to 10, and, for each of the scanning lines, a blank interval between the final reset operation and the write operation ranges from 0 to 3T/n.

20. The driving method according to claim 19, wherein the step of performing a reset operation includes a step of adjusting the number of scanning lines that are reset simultaneously and the blank interval.

* * * * *